US009488065B2

(12) United States Patent
Olmstead

(10) Patent No.: US 9,488,065 B2
(45) Date of Patent: Nov. 8, 2016

(54) VARIABLE GEOMETRY TURBINE

(71) Applicant: Cummins Ltd., Huddersfield (GB)

(72) Inventor: James Charles Olmstead, Columbus, IN (US)

(73) Assignee: Cummins Ltd., Huddersfield (GB)

( * ) Notice: Subject to any disclaimer, the term of this patent is extended or adjusted under 35 U.S.C. 154(b) by 910 days.

(21) Appl. No.: 13/718,547

(22) Filed: Dec. 18, 2012

(65) Prior Publication Data

US 2013/0177403 A1 Jul. 11, 2013

(30) Foreign Application Priority Data

Dec. 21, 2011 (GB) ..... 1122024.1

(51) Int. Cl.
*F01D 17/12* (2006.01)
*F01D 17/16* (2006.01)
*F01D 17/14* (2006.01)

(52) U.S. Cl.
CPC ..... *F01D 17/16* (2013.01); *F01D 17/143* (2013.01); *F01D 17/167* (2013.01); *F05D 2220/40* (2013.01); *F05D 2240/12* (2013.01)

(58) Field of Classification Search
CPC .... F01D 17/16; F01D 17/167; F01D 17/143; F01D 17/14; F01D 17/141; F01D 17/146; F01D 17/10
USPC ..... 415/159
See application file for complete search history.

(56) References Cited

U.S. PATENT DOCUMENTS 5,868,552 A 2/1999 McKean et al.
6,694,733 B1 * 2/2004 Bernardini ..... F01D 17/167 415/157

(Continued)

FOREIGN PATENT DOCUMENTS

CN 1423727 6/2003
CN 101542074 9/2009

(Continued)

OTHER PUBLICATIONS

Loeffler, DE102012005216A1, Oct. 19, 2013, Specification translation.*

(Continued)

*Primary Examiner* — Craig Kim
*Assistant Examiner* — Jason Fountain
(74) *Attorney, Agent, or Firm* — Taft Stettinius & Hollister LLP

(57) ABSTRACT

A variable geometry turbine comprise a housing; a turbine wheel supported in the housing for rotation about a turbine axis; and an annular inlet passage upstream of said turbine wheel defined between respective inlet surfaces defined by an annular nozzle ring and a facing annular shroud. The nozzle ring and shroud are axially movable relative to one another to vary the size of the inlet passage; the nozzle ring having a circumferential array of inlet vanes extending across the inlet passage. The shroud covers the opening of a shroud cavity and defines a circumferential array of vane slots, each vane slot corresponding to an inlet vane, the vane slots and shroud cavity being configured to receive said inlet vanes to accommodate axial movement of the nozzle ring. At least one vane slot has a first side corresponding to a first side of the corresponding inlet vane and a second side corresponding to a second side of the corresponding inlet vane, the first side of the vane slot being located a shorter radial distance from the turbine wheel than the second side of the vane slot. The at least one vane slot has a leading end corresponding to a leading end of a corresponding inlet vane, and a trailing end downstream of the leading end, the trailing end corresponding to a trailing end of the inlet vane. A vane chord extends in a straight line between the a leading end tip and a trailing end tip of the inlet vane. The at least one vane slot has an increased clearance portion, the clearance between a portion of the at least one vane slot, which forms part of the increased clearance portion, and an adjacent portion of the inlet vane being greater than the clearance between a further portion of the at least one vane slot, which does not form part of the increased clearance portion, and an adjacent portion of the inlet vane. The increased clearance portion is located at the second side of the vane slot and extending from a trailing end tip of the trailing end of the vane slot to a point which is a distance from the trailing end of the vane slot, in the direction of the vane chord, that is greater than about 10% of the length of the vane chord.

12 Claims, 6 Drawing Sheets

(56) References Cited

U.S. PATENT DOCUMENTS

| | | | | |
|---|---|---|---|---|
| 8,601,812 | B2 | 12/2013 | Parker | |
| 8,764,388 | B2 * | 7/2014 | Roberts | F01D 17/167 415/158 |
| 2011/0123316 | A1 | 5/2011 | Roberts et al. | |

FOREIGN PATENT DOCUMENTS

| | | | | |
|---|---|---|---|---|
| DE | 10 2008 032 497 | A1 | 1/2010 | |
| DE | 102008032497 | | 1/2010 | |
| DE | 102012005216 | A1 * | 9/2013 | F02B 37/24 |
| EP | 1900908 | | 3/2008 | |
| GB | 2462115 | | 1/2010 | |
| GB | 2462115 | A | 1/2010 | |
| WO | 2011067577 | | 6/2011 | |

OTHER PUBLICATIONS

United Kingdom Search Report, dated Apr. 11, 2012, pp. 1, United Kingdom Application No. GB1122024.1, United Kingdom Intellectual Property Office.

Chinese Office Action, CN201210563238.6, Jun. 24, 2015, 6 pgs. along withe English translation (3 pgs.).

United Kingdom Office Action, GB1122024.1, Apr. 11, 2012, 3 pgs.

* cited by examiner

VARIABLE GEOMETRY TURBINE

The present invention relates to a variable geometry turbine. Particularly, but not exclusively, the present invention relates to a variable geometry turbine for a turbocharger or other turbomachine.

A turbomachine comprises a turbine. A conventional turbine comprises an exhaust gas driven turbine wheel mounted on a rotatable shaft within a turbine housing connected downstream of an engine outlet manifold. One type of turbomachine is a turbocharger, In the case of a turbocharger, rotation of the turbine wheel drives a compressor wheel mounted on the other end of the shaft within a compressor housing to deliver compressed air to an engine intake manifold. Another type of turbomachine is a power turbine. In the case of a power turbine, rotation of the turbine wheel may drive a gear which transmits mechanical power to an engine (for example an engine flywheel) or to a generator (for example, an electrical generator). The turbine shaft of a turbomachine is conventionally supported by journal and thrust bearings, including appropriate lubricating systems, located within a bearing housing.

Turbochargers are well known devices for supplying air to the intake of an internal combustion engine at pressures above atmospheric pressure (boost pressures). Turbochargers comprise a turbine having a turbine housing which defines a turbine chamber within which the turbine wheel is mounted; an annular inlet passageway defined between opposite radial walls arranged around the turbine chamber; an inlet arranged around the inlet passageway; and an outlet passageway extending from the turbine chamber. The passageways and chambers communicate such that pressurised exhaust gas admitted to the inlet chamber flows through the inlet passageway to the outlet passageway via the turbine and rotates the turbine wheel. Turbine performance can be improved by providing vanes, referred to as nozzle vanes or inlet vanes, in the inlet passageway so as to deflect gas flowing through the inlet passageway towards the direction of rotation of the turbine wheel.

Turbines may be of a fixed or variable geometry type. Variable geometry turbines differ from fixed geometry turbines in that the size of the inlet passageway can be varied to optimise gas flow velocities over a range of mass flow rates so that the power output of the turbine can be varied to suite varying engine demands. For instance, when the volume of exhaust gas being delivered to the turbine is relatively low, the velocity of the gas reaching the turbine wheel is maintained at a level which ensures efficient turbine operation by reducing the size of the annular inlet passageway. Turbochargers provided with a variable geometry turbine are referred to as variable geometry turbochargers.

In one known type of variable geometry turbine, an array of nozzle vanes (generally referred to as a "nozzle ring") is disposed in the inlet passageway and is fixed to an axially movable wall member that slides across the inlet. The axial position of movable wall member (and hence the nozzle ring) relative to a facing wall of the inlet passageway is adjustable to control the axial width of the inlet passageway. For example, the axially movable wall member may be moved towards the facing wall in order to close down the inlet passageway. The facing wall has an array of vane slots which correspond to the nozzle vanes of the nozzle ring such that, as the axially movable wall member is moved towards the facing wall to close down the inlet passageway, the nozzle vanes pass through the vane slots. In this way, the vane slots accommodate movement of the nozzle ring. The facing wall of the inlet passageway and the array of vane slots are defined by a "shroud". In this example, as gas flow through the turbine decreases, the inlet passageway width may be decreased, in order to maintain gas velocity and optimise turbine output, by moving the movable wall member (and hence the nozzle ring) towards the shroud. Alternatively, in another embodiment of this type of variable geometry turbine, the nozzle ring is fixed to a wall of the turbine and the shroud may be fixed to the movable wall member such that the movable wall member (and hence the shroud) is moved towards the nozzle ring to decrease the size of the inlet passageway. This type of variable geometry turbine may be referred to as a sliding wall or sliding nozzle variable geometry turbine.

The arrangements described above differ from another type of variable geometry turbine in which a variable guide vane array comprises adjustable swing guide vanes arranged to pivot so as to open and close the inlet passageway.

A known shroud which forms part of a sliding nozzle variable geometry turbine comprises an annular plate, also referred to as a shroud plate, which is mounted in the mouth of an annular shroud cavity. The shroud plate may be held in position by a retaining ring located in a circumferential groove provided in the outer periphery of the shroud plate and extending into a circumferential groove provided in the turbine housing around the mouth of the shroud cavity. The retaining ring may be a split ring of a form commonly referred to as a "piston ring".

In a known variable geometry turbine, the axially movable wall member typically comprises a radially extending wall (defining one wall of the inlet passageway, and from which the nozzle ring extends) and radially inner and outer axially extending walls or flanges which extend into an annular cavity behind the radial face of the nozzle ring. In the case where the turbine forms part of a turbocharger, the cavity may be formed in a part of the turbocharger housing (usually either the turbine housing or the turbocharger bearing housing) and accommodates axial movement of the nozzle ring. The flanges may be sealed with respect to the cavity walls to reduce or prevent leakage flow around the back of the movable wall member.

In one arrangement of a variable geometry turbine the movable wall member (and in this case the nozzle ring) is supported on rods extending parallel to the axis of rotation of the turbine wheel and is moved by an actuator which axially displaces the rods. Nozzle ring actuators can take a variety of forms, including pneumatic, hydraulic and electric and can be linked to the nozzle ring in a variety of ways. The actuator will generally adjust the position of the nozzle ring under the control of an engine control unit (ECU) in order to modify the airflow through the turbine to meet performance requirements. In some examples the actuator will adjust the position of the nozzle ring to meet a position commanded by the engine control unit (ECU).

The array of nozzle vanes of the nozzle ring and the corresponding array of vane slots of the shroud have a mating fit of a sliding type. It is common when manufacturing any set of components which have a mating fit of a sliding type to provide a small clearance between the mating components. This not only enables the mating components to slide relative to one another, but also provides tolerance for machining inaccuracies and a small degree of thermal expansion.

In some sliding nozzle variable geometry turbines an increased clearance portion is provided in the vane slots in order to accommodate the thermal expansion of certain portions of the nozzle vanes, these portions of the nozzle vanes being those which experience the greatest thermal expansion. For example, in some cases the portion of the nozzle vane which may experience the greatest thermal expansion may be a tip of the vanes. In other cases, thermal expansion in one portion of a nozzle vane cause the vane to distort such that another portion of the vane contacts an edge of a corresponding vane slot. By accommodating thermal expansion of certain portions of the nozzle vanes it was thought that this would prevent the thermally expanded portions of the nozzle vanes from contacting the corresponding edges of the nozzle slots. By preventing the thermally expanded portions of the nozzle vanes from contacting the corresponding edges of the nozzle slots, it was thought that this would minimise the occurrence of the nozzle vanes jamming against the vane slots of the shroud, and therefore minimise jamming of the nozzle ring relative to the shroud hence preventing the variable geometry mechanism from becoming inoperable.

If a nozzle vane of the nozzle ring and nozzle slot of the shroud become jammed the variable geometry mechanism will either become inoperative or will have a reduced range of operation. In order to return the turbocharger to its correct operating condition it may be necessary to service the turbocharger or replace components of the turbocharger. The cost of such servicing or replacement may be considerable.

The present invention seeks to obviate or mitigate at least one of the disadvantages discussed above, or other disadvantages associated with prior art turbines.

According to a first aspect of the present invention there is provided a variable geometry turbine comprising a housing; a turbine wheel supported in the housing for rotation about a turbine axis; an annular inlet passage upstream of said turbine wheel defined between respective inlet surfaces defined by an annular nozzle ring and a facing annular shroud; the nozzle ring and shroud being axially movable relative to one another to vary the size of the inlet passage; the nozzle ring having a circumferential array of inlet vanes extending across the inlet passage; the shroud covering the opening of a shroud cavity and defining a circumferential array of vane slots, each vane slot corresponding to an inlet vane, the vane slots and shroud cavity being configured to receive said inlet vanes to accommodate axial movement of the nozzle ring; wherein at least one vane slot has a first side corresponding to a first side of the corresponding inlet vane and a second side corresponding to a second side of the corresponding inlet vane, the first side of the vane slot being located a shorter radial distance from the turbine wheel than the second side of the vane slot; wherein the at least one vane slot has a leading end corresponding to a leading end of a corresponding inlet vane, and a trailing end downstream of the leading end, the trailing end corresponding to a trailing end of the inlet vane; wherein a vane chord extends in a straight line between the a leading end tip and a trailing end tip of the inlet vane; wherein the at least one vane slot has an increased clearance portion, the clearance between a portion of the at least one vane slot, which forms part of the increased clearance portion, and an adjacent portion of the inlet vane being greater than the clearance between a further portion of the at least one vane slot, which does not form part of the increased clearance portion, and an adjacent portion of the inlet vane; the increased clearance portion being located at the second side of the vane slot and extending from a trailing end tip of the trailing end of the vane slot to a point which is a distance from the trailing end of the vane slot, in the direction of the vane chord, that is greater than about 10% of the length of the vane chord.

The maximum clearance between the increased clearance portion of the vane slot may occur between a maximum clearance portion of the vane slot and the inlet vane, the maximum clearance being greater than the thickness of a portion of the inlet vane which is aligned with the maximum clearance portion in a direction which is perpendicular to the vane chord; the thickness of the vane being measured perpendicular to the vane chord.

According to a second aspect of the present invention there is provided a variable geometry turbine comprising a housing; a turbine wheel supported in the housing for rotation about a turbine axis; an annular inlet passage upstream of said turbine wheel defined between respective inlet surfaces defined by an annular nozzle ring and a facing annular shroud; the nozzle ring and shroud being axially movable relative to one another to vary the size of the inlet passage; the nozzle ring having a circumferential array of inlet vanes extending across the inlet passage; the shroud covering the opening of a shroud cavity and defining a circumferential array of vane slots, each vane slot corresponding to an inlet vane, the vane slots and shroud cavity being configured to receive said inlet vanes to accommodate axial movement of the nozzle ring; wherein at least one vane slot has a first side corresponding to a first side of the corresponding inlet vane and a second side corresponding to a second side of the corresponding inlet vane, the first side of the vane slot being located a shorter radial distance from the turbine wheel than the second side of the vane slot; wherein the at least one vane slot has a leading end corresponding to a leading end of a corresponding inlet vane, and a trailing end downstream of the leading end, the trailing end corresponding to a trailing end of the inlet vane; wherein a vane chord extends in a straight line between the leading and trailing and of the inlet vane; wherein the at least one vane slot has an increased clearance portion, the clearance between a portion of the at least one vane slot, which forms part of the increased clearance portion, and an adjacent portion of the inlet vane being greater than the clearance between a further portion of the at least one vane slot, which does not form part of the increased clearance portion, and an adjacent portion of the inlet vane; the increased clearance portion being located at the second side of the vane slot and extending from a trailing end tip of the trailing end of the vane; and wherein the maximum clearance between the increased clearance portion of the vane slot and the inlet vane occurs between a maximum clearance portion of the vane slot and an adjacent portion of the inlet vane, the maximum clearance being greater than the thickness of the adjacent portion of the inlet vane, the adjacent portion of the inlet vane being aligned with the maximum clearance portion of the vane slot in a direction which is perpendicular to the vane chord; the thickness of the adjacent portion of the inlet vane being measured perpendicular to the vane chord.

The maximum clearance may be greater than about at least one of about 1.25, about 1.5, about 1.75 and about 2 times the thickness of the adjacent portion of the inlet vane.

The maximum clearance between the increased clearance portion of the vane slot and the inlet vane may be less than about 7 times the thickness of the adjacent portion of the inlet vane.

The shroud may comprise a shroud plate defining a generally radial surface, the circumferential array of vane slots passing through the generally radial surface.

The increased clearance portion of the at least one vane slot may comprise a main region and a tapered region, the main region extending from the trailing end tip of the trailing end of the vane towards leading end of the vane slot 25*k*, the tapered region adjoining the main region.

The clearance between the vane and the edge of the vane slot within the main region of the increased clearance portion may be greater than that of the clearance between the vane and edge of the vane slot in the tapered region of the increased clearance portion.

According to third aspect of the invention there is a provided a turbocharger comprising a turbine according to any of the preceding aspects.

Specific embodiments of the present invention will now be described, by way of example only, with reference to the accompanying drawings, in which.

Figure 1:
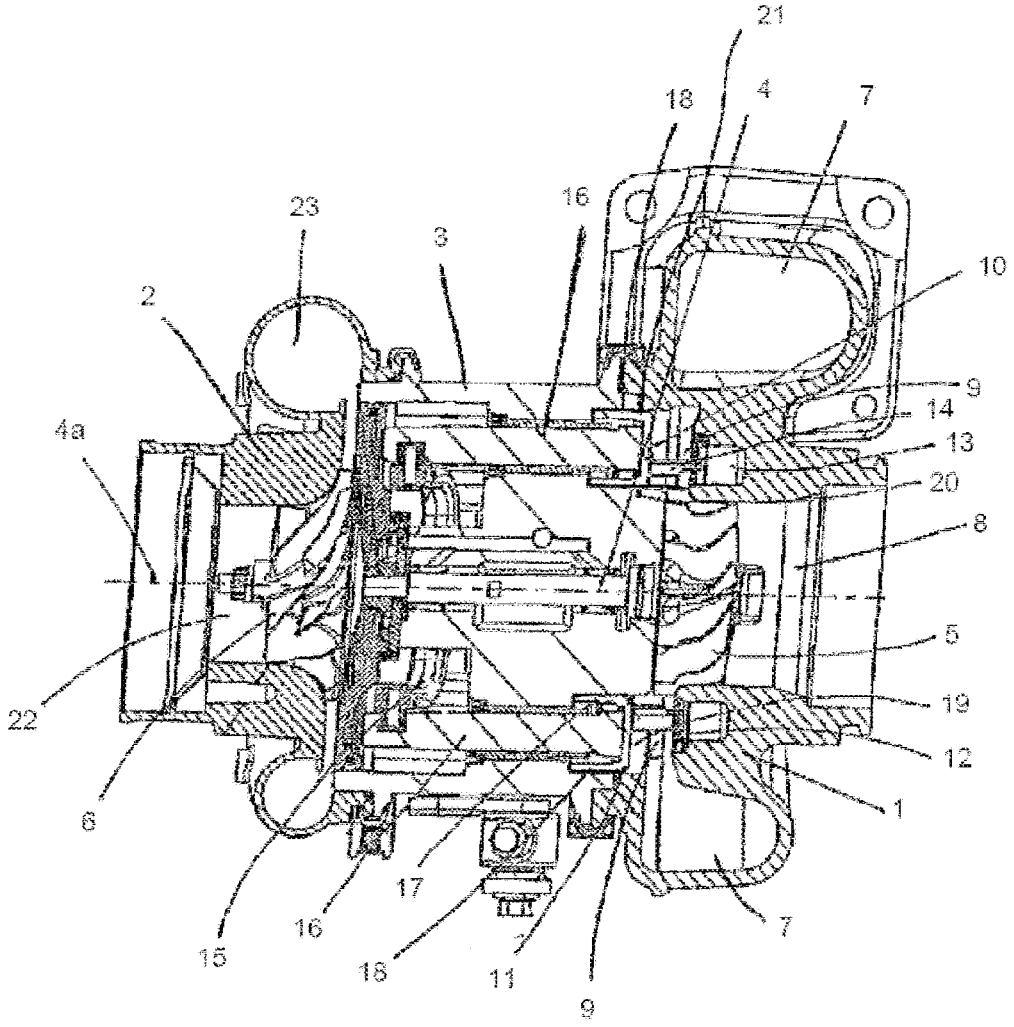
FIG. 1 is an axial cross-section through a variable geometry turbocharger according to an embodiment of the invention.
Figure 2:
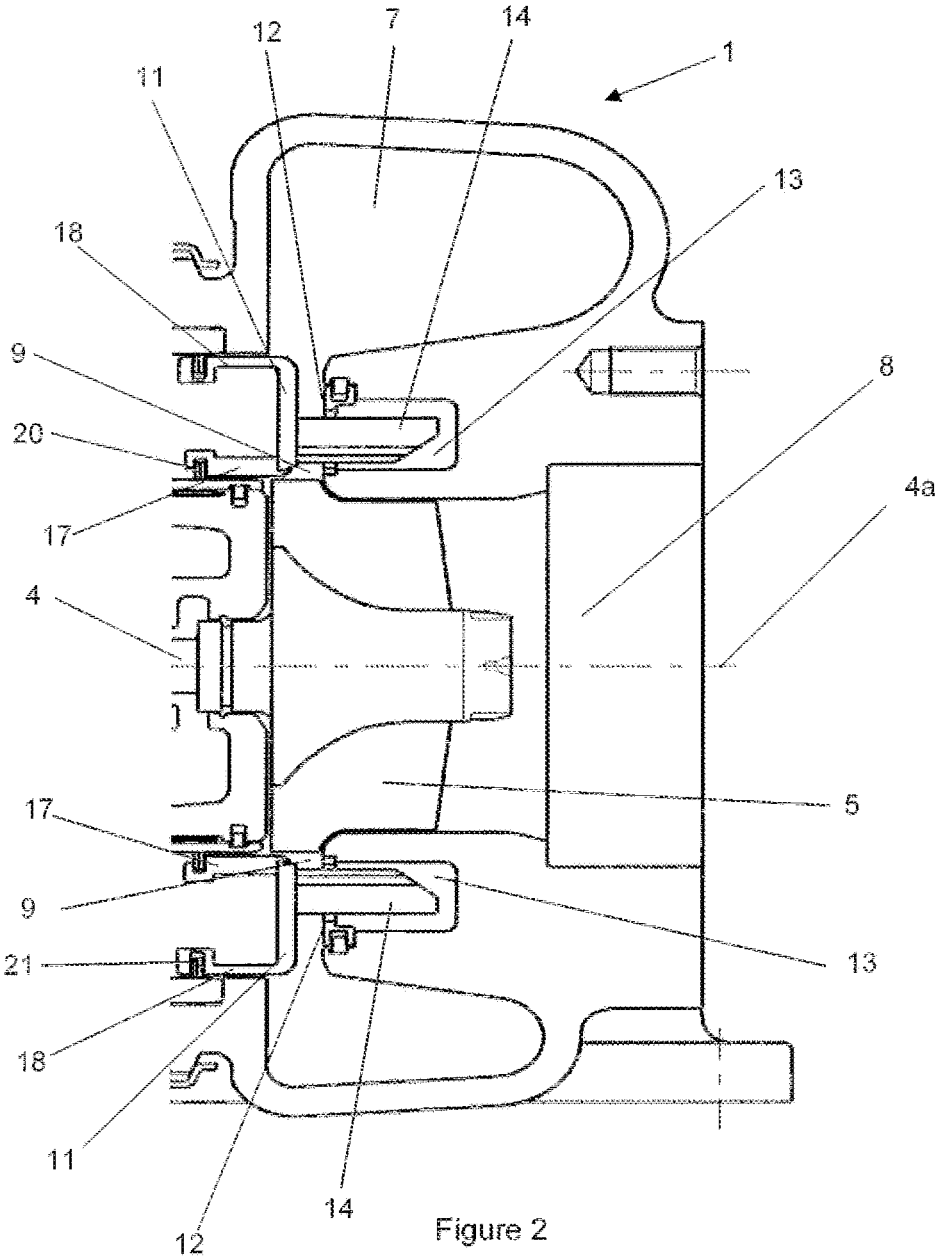
FIG. 2 is an axial cross-section through the turbine of the turbocharger shown in FIG. 1.

FIGS. 1 and 2 illustrate a variable geometry turbocharger in accordance with an embodiment of the present invention. The variable geometry turbocharger comprises a variable geometry turbine housing 1 and a compressor housing 2 interconnected by a central bearing housing 3. A turbocharger shaft 4 extends from the turbine housing to the compressor housing 2 through the bearing housing 3. A turbine wheel 5 is mounted on one end of the shaft 4 for rotation within the turbine housing 1, and a compressor wheel 6 is mounted on the other end of the shaft 4 for rotation within the compressor housing 2. The shaft 4 rotates about turbocharger axis 4*a* on bearing assemblies located in the bearing housing 3.

The turbine housing 1 defines an inlet volute 7 to which gas from an internal combustion engine (not shown) is delivered. The exhaust gas flows from the inlet volute 7 to an axial outlet passageway 8 via an annular inlet passageway 9 and the turbine wheel 5. The inlet passageway 9 is defined on one side by a face 10 of a radial wall of a movable annular wall member 11, which my be referred to as a "nozzle ring", and on the opposite side by a second wall member comprising an annular shroud 12 which forms the wall of the inlet passageway 9 facing the nozzle ring 11. The shroud 12 covers the opening of an annular recess, or shroud cavity, 13 in the turbine housing 1. The shroud 12 comprises an annular shroud plate.

The nozzle ring 11 comprises an array of circumferentially, equally spaced inlet vanes 14 each of which extends across the inlet passageway 9. The vanes 14 are orientated to deflect gas flowing through the inlet passageway 9 towards the direction of rotation of the turbine wheel 5. The vanes 14 project through suitably configured vane slots in the shroud plate of the shroud 12, and into the shroud cavity 13, to accommodate movement of the nozzle ring 11.

The position of the nozzle ring 11 is controlled by an actuator assembly of the type disclosed in U.S. Pat. No. 5,868,552. An actuator (not shown) is operable to adjust the position of the nozzle ring 11 via an actuator output shaft (not shown), which is linked to a yoke 15. The yoke 15 in turn engages axially extending actuating rods 16 that support the nozzle ring 11. Accordingly, by appropriate control of the actuator (which may for instance be pneumatic or electric), the axial position of the rods 16 and thus of the nozzle ring 11 can be controlled. The speed of the turbine wheel 5 is dependent upon the velocity of the gas passing through the annular inlet passageway 9. For a fixed rate of mass of gas flowing into the inlet passageway 9, the gas velocity is a function of the width of the inlet passageway 9, the width being adjustable by controlling the axial position of the nozzle ring 11. FIG. 1 shows the annular inlet passageway 9 fully open. The inlet passageway 9 may be closed to a minimum by moving the nozzle ring 11 (and hence the face 10 of the nozzle ring 11) towards the shroud 12.

The nozzle ring 11 has axially extending radially inner and outer annular flanges 17 and 18 that extend into an annular cavity 19 provided in the turbine housing 1. Inner and outer sealing rings 20 and 21 are provided to seal the nozzle ring 11 with respect to inner and outer annular surfaces of the annular cavity 19 respectively, whilst allowing the nozzle ring 11 to slide within the annular cavity 19. The inner sealing ring 20 is supported within an annular groove formed in the radially inner annular surface of the cavity 19 and bears against the inner annular flange 17 of the nozzle ring 11. The outer sealing ring 20 is supported within an annular groove formed in the radially outer annular surface of the cavity 19 and bears against the outer annular flange 18 of the nozzle ring 11.

Gas flowing from the inlet volute 7 to the outlet passageway 8 passes over the turbine wheel 5 and as a result torque is applied to the shaft 4 to drive the compressor wheel 6. Rotation of the compressor wheel 6 within the compressor housing 2 pressurises ambient air present in an air inlet 22 and delivers the pressurised air to an air outlet volute 23 from which it is fed to an internal combustion engine (not shown).

Figure 3:
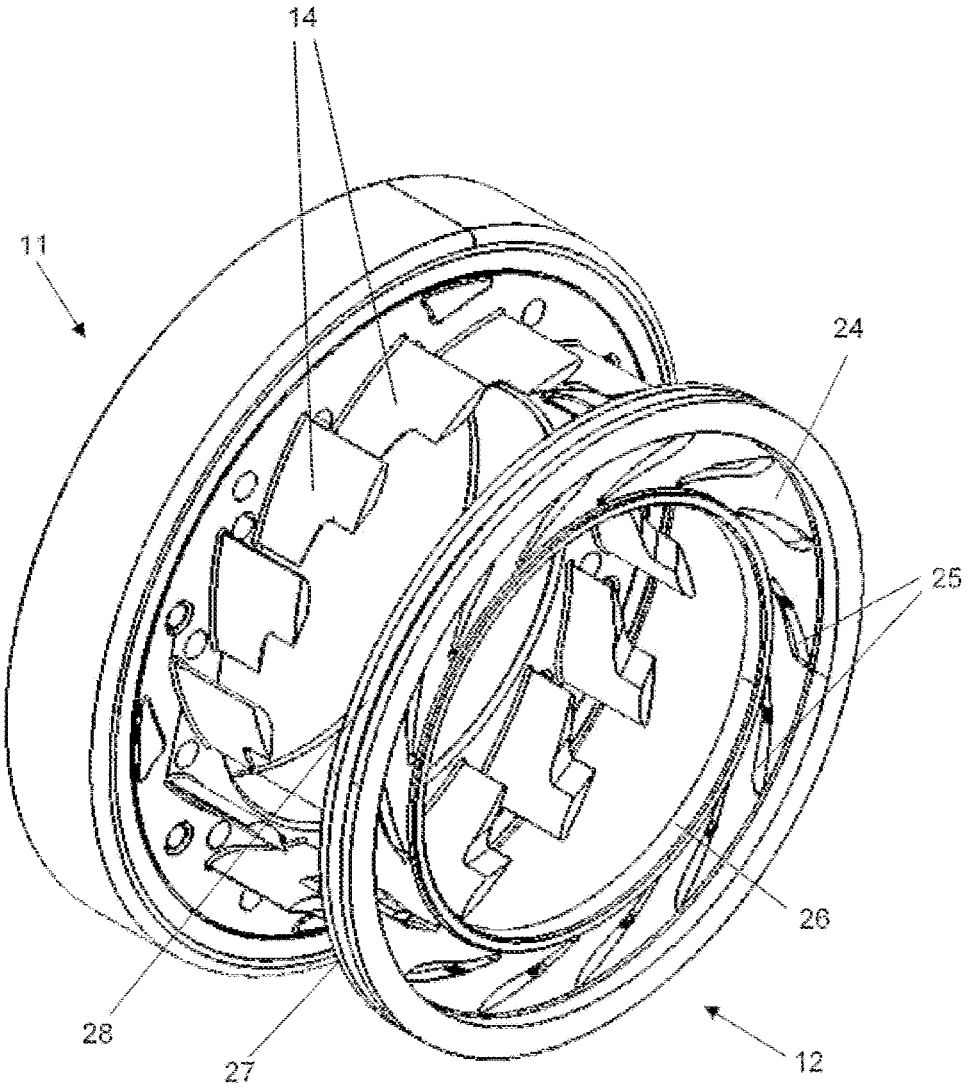
FIG. 3 is a perspective view of a nozzle dug and a shroud plate which form part of a known turbocharger turbine.

FIG. 3 shows a shroud 12 and nozzle ring 11 of a known turbocharger. The shroud 12 comprises an annular plate (also referred to as a shroud plate) comprising a radially extending shroud wall 24 provided with vane slots 25 for the receipt of the vanes 14 of the nozzle ring 11.

The radially inner periphery of the annular shroud wall 24 is formed with an axially extending flange 26, which extends in an inboard direction away from the turbine inlet 9 when the shroud 12 is in position in the turbine housing, and provides means for seating the inner periphery of the shroud 12 in the mouth of the shroud cavity 13.

The radially outer periphery of the shroud plate 24 is formed with a grooved flange 27. The flange 27 extends axially inboard from the shroud plate wall 24 to a greater extent than the inner shroud 26, and defines an annular groove 28 around the radially outer periphery of the shroud.

Figure 4:
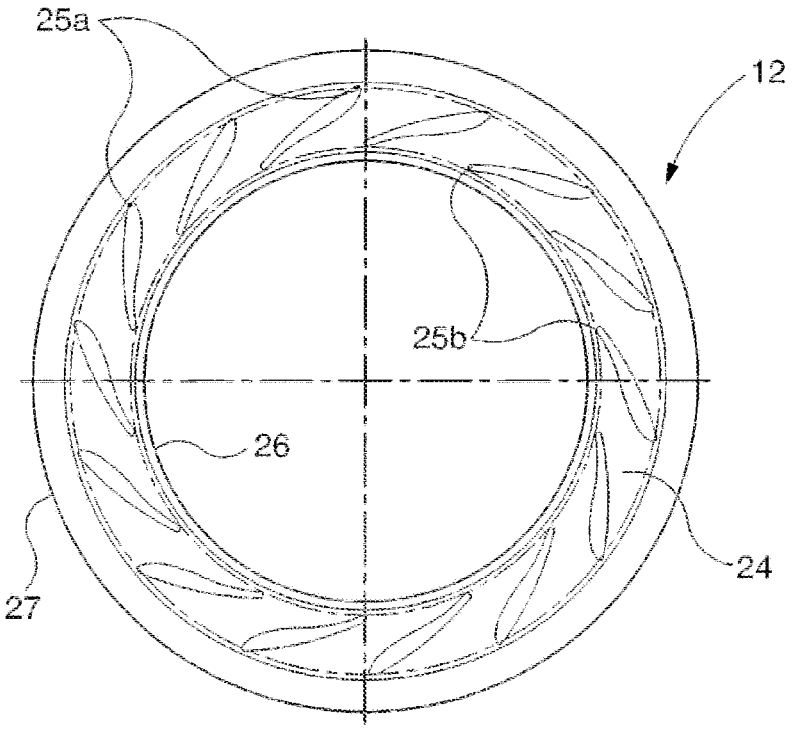
FIG. 4 is an end-on view of the shroud plate shown in FIG. 3.

FIG. 4 shows an end on view of the shroud 12 shown in FIG. 3. The vane slots 25 of the shroud plate 24 each have a leading end 25*a* and a trailing end 25*b*. The trailing end 25*b* of each vane slot is downstream of the vane slot's leading end 25*a*. That is to say, in use, gas flowing through the turbine may flow first past a leading end 25*a* of a vane slot 25 and then past the trailing end 25*b* of the vane slot 25.

Figure 5:
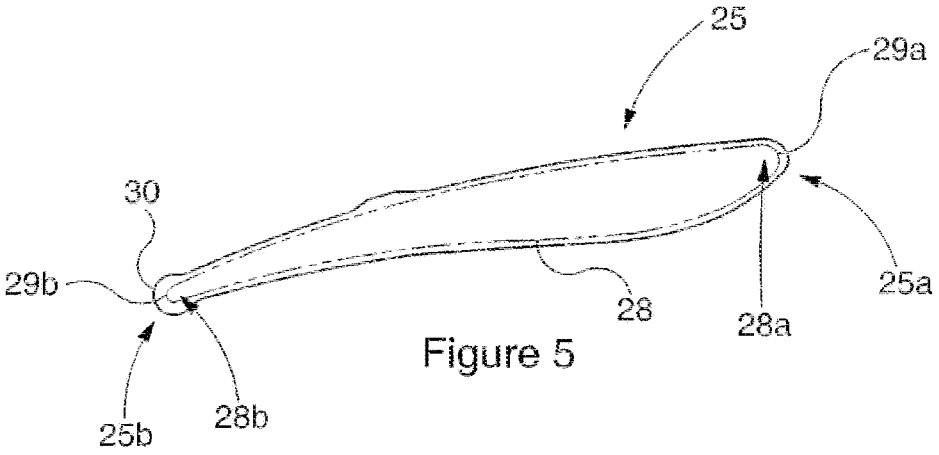
FIG. 5 shows a vane slot in the shroud plate shown in FIGS. 3 and 4; additionally showing the location of a vane within the vane slot.

FIG. 5 shows an enlarged view of a single vane slot 25 of the shroud shown in FIGS. 3 and 4. The Figure also shows in dotted line 28 the outline of a portion of a vane 14 when it is received by the vane slot 25. As previously discussed, the vane slot has a leading end 25*a* and a trailing end 25*b*. The leading end 25*a* of the vane slot 25 corresponds to a leading end 28*a* of the vane (the extent of which is indicated by the dotted line 28). The trailing end 25*b* of the vane slot 25 corresponds to a trailing end 28*b* of the vane (the extent of which is indicated by the dotted line 28). The vane 14 has a leading end tip 29*a* at the leading end 28*a* of the vane 14 and a trailing end tip 29*b* at the trailing end 28*b* of the vane 14.

The most common type of known vane slot is configured such that there is a constant separation (or clearance) between the edge of the vane slot and the corresponding vane which is received by the vane slot. That is to say that the separation between any part of the edge of the vane slot and the adjacent part of the vane is substantially constant.

FIG. 5 shows a known vane slot 25 and the outline 28 of a corresponding vane which is received by the vane slot 25. It had previously been thought that thermal expansion of the vane due to the high operating temperatures of the turbine caused the trailing end 28*b* of the vane to extend in a direction substantially away from the leading end 28*a* of the vane. It was thought that the extension of the trailing end 28*b* of the vane due to thermal expansion could cause the vane to contact a portion of the edge of the vane slot 25 such that the vane and vane slot 25 jam into one another. In order to try to prevent this, a bulbous region 30 was incorporated into the trailing end of the vane slot 25. The bulbous region 30 is a portion of the vane slot 25 adjacent the trailing end tip 29*b* of the trailing end 28*b* of the vane which has an increased separation between the vane slot 25 and the vane compared to the separation between other portions of the vane and the respective adjacent edge of the vane slot 25.

However, surprisingly, the applicant has found that providing a bulbous region 30 (i.e. an increased separation portion in order to accommodate the thermal expansion of the tip 30 of the vane) does not, in some applications, prevent the jamming of the nozzle ring and the shroud. I.e. surprisingly, it was found that, in some applications, providing an increased clearance portion in the vane slots which corresponds to the portions of the vanes which experience the greatest thermal expansion did not eliminate the occurrence of jamming of the nozzle ring relative to the shroud.

If a vane of the nozzle ring and slot of the shroud become jammed the variable geometry mechanism will either become inoperative or will have a reduced range of operation. In order to return the turbocharger to its correct operating condition it may be necessary to service the turbocharger or replace components of the turbocharger. The cost of such servicing or replacement may be considerable.

Referring once again to FIGS. 1 and 2, in use, as previously discussed, gas flows into the turbine 1 via the volute 7 and inlet passageway 9. The gas then flows past the turbine wheel 5 to the turbine outlet 8. In some variable geometry turbines the gas which flows into the turbine 1 may contain contaminants. These contaminants may be foreign objects, such as solids other than those produced as a product of combustion within the engine to which the turbine is attached. These contaminants may enter the turbine along with the gas provided to the turbine. The contaminants may flow via the volute 7 and inlet passageway 9 towards the turbine wheel 5. In use, the turbine wheel 5 of the turbine 1 may be rotated at high speed due to a force exerted on the turbine wheel 5 by the gas supplied to the turbine. For example, the turbine wheel of some known turbines may have a rotational speed in excess of 100,000 rpm.

If contaminants present in the gas supplied to the turbine come into contact with the rotating turbine wheel 5 they can be struck by the turbine wheel 5 which may cause the contaminants to travel in a generally radially outward direction. The contaminants which are struck by the turbine wheel 5 and hence travel in a generally radially outward direction may collide with one of the vanes 14. Due to the high speed at which the turbine wheel 5 rotates in use, any contaminant which is struck by the turbine wheel 5 may be caused to travel at high speeds.

In some cases, the applicant has found that, surprisingly, contaminant travelling at the high speed caused by colliding with the turbine wheel 5 colliding with a vane may exert sufficient force on the vane 14 such that the vane is deformed by the collision with the contaminant. In some cases, the force of the collision of the contaminant with the vane (or the total force of a number of simultaneous collisions between contaminants and the vane) may be sufficient so that the deformation of the vane 14 is a plastic deformation. In this case the configuration of the vane (for example its shape) will be permanently altered.

Furthermore, the applicant has appreciated that if one or more of the vanes of the nozzle ring is deformed than the one or more deformed vanes may be deformed to an extent that they may contact an edge of the corresponding vane slot(s). If at least one vane contacts the edge of a vane slot, then relative movement between the nozzle ring and the shroud may be limited or prevented. Consequently, the ability to adjust the width of the inlet passageway may be limited or prevented. The applicant has therefore appreciated that surprisingly, it is not only thermal expansion of the vanes which may cause jamming of the nozzle ring and shroud in certain applications, but also deformation of the nozzle vanes due to deflected contaminants If the configuration of a vane (for example the shape of the vane) is altered then the vane may no longer be capable of moving freely through its corresponding vane slot when the nozzle ring is moved. For example, the vane may jam into an edge of the corresponding vane slot. In this case, the variable geometry mechanism of the turbocharger will be inoperable or will have a decreased range of operation and as such the operating performance of the turbocharger may be reduced.

FIGS. 6 to 9 each show a separate vane slot according to embodiments of the present invention. The vane slots shown in each Figure (numbered 25*i*, 25*j*, 25*k* and 25*l* respectively) each have a leading end 25*a* and a trailing end 25*b*.

FIGS. 6 to 9 also show in dotted line the outline of the prior art vane slot shown in FIG. 5, so as to enable easy comparison between the vane slots of the invention shown in FIGS. 6 to 9 and as shown in FIG. 5.

It can be seen that each of the vane slots in accordance with an embodiment of the present invention shown in FIGS. 6 to 9 has an increased clearance portion 40 towards the trailing end 25*b* of the vane slot. In each case, the increased clearance portion is located on the side of the vane slot which is located further away from the turbine wheel. In the case of FIGS. 6 to 9, the side of the vane slot which is located away from the turbine wheel is the side of the vane slot shown at the top of each figure.

It can be seen from the FIGS. 6 to 9 that the increased clearance portion may have any appropriate shape, but that it is always located at the trailing end 25*b* of the vane slot, and it is always located on the side of the vane slot away from the turbine wheel. In the embodiments shown in FIGS. 6 to 9 the increased clearance portion extends from a trailing end tip 31 of the vane slot located at the trailing end 28*b* of the vane slot.

Figure 8:
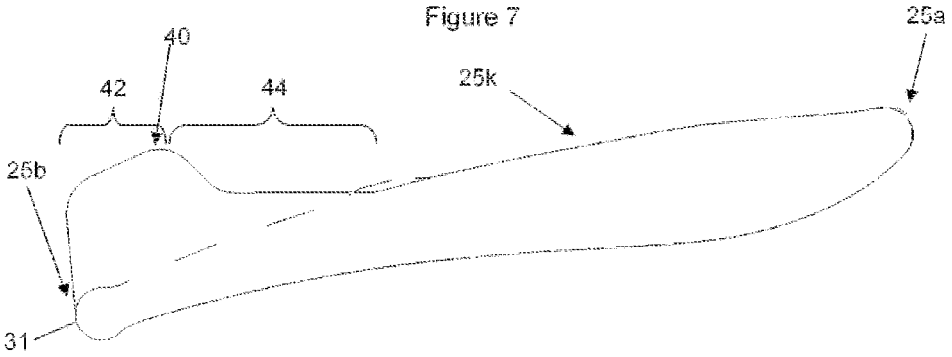
Figure 10:
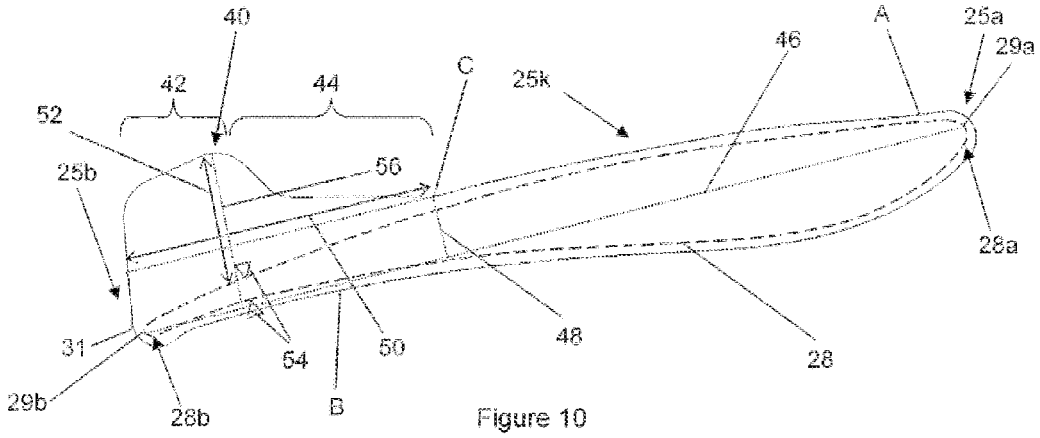
FIG. 10 is a vane slot as shown in FIG. 8, additionally showing the location of a vane within the vane slot.

FIG. 10 shows the vane slot 25*k* of FIG. 8. The location of a vane when it is received by the vane slot 25*k* is indicated by the dotted line 28. As before, the vane slot has a leading end 25*a* and a trailing end 25*b* which corresponds to the location of a leading end 28*a* and a trailing end 28*b* of the vane 28, in use, the leading end of the vane and vane slot 28*a* is upstream of the trailing end of the vane and vane slot 28*b* having regard to the direction of flow of the gas through the turbine.

It can be seen that around the majority of the vane the spacing between the vane 28 and the edge of the vane slot 25*k* is substantially constant. For example, the spacing between the vane 28 and the vane slot 25*k* at the position marked A is substantially the same as the spacing between the vane 28 and the vane slot 25*k* at the position indicated by 'B'. The position indicated by A is located towards the leading end of the vane and vane slot, and on the side of the vane slot which is away from the turbine wheel. The location indicated by B is located towards the trailing end of the vane and vane slot, and on the side of the vane slot which is closest to the turbine wheel. The vane slot has an increased clearance portion 40 which is located, at least in part, at the trailing end of the vane slot and on the side of the vane slot furthest away from the turbine wheel.

The increased clearance portion 40 comprises a main region 42 and a tapered region 44. The main region 42 extends from the trailing end tip 31 of the trailing end 25*b* of the vane slot towards leading end 25*a* of the vane slot 25*k*. The tapered region 44 adjoins the main region 42. In this embodiment the clearance between the vane 28 and the edge of the vane slot 25*k* within the main region 42 of the increased clearance portion 40 is greater than that of the clearance between the vane 28 and edge of the vane slot 25*k* in the tapered region 44 of the increased clearance portion 40.

The clearance between the vane slot (i.e. the edge of the vane slot) and the vane in the increased clearance portion of the vane slot is greater than the clearance between the edge of the vane slot and the vane in the portion of the vane slot which is not the increased clearance portion.

The clearance between the vane slot and the vane may be defined as the clearance between a portion of the vane slot (or a position along the edge of the vane slot) and an adjacent portion of the inlet vane. In general, adjacent portion of the inlet vane is the portion of the inlet vane which is the shortest straight line distance from said portion of the vane sot. In this case, the clearance between the portion of the vane slot (or the position along the edge of the vane slot) and the vane is the shortest distance between the portion of the vane slot and the vane.

Alternatively, the clearance between the vane slot and the vane may be defined as the clearance between a portion of the vane (e.g. a given point on the surface of the vane) and an adjacent portion of the vane slot. In general, adjacent portion of the vane slot is the portion of the vane slot which is the shortest straight line distance from said portion of the vane. In this case, the clearance between the portion of the vane and the vane slot is the shortest distance between the portion of the vane and the vane slot.

The clearance between a portion of the vane slot, which forms part of the increased clearance portion, and an adjacent portion of the inlet vane is greater than the clearance between a further portion of the vane slot, which does not form part of the increased clearance portion, and an adjacent portion of the inlet vane.

Alternative methods may be used in order to determine the clearance between a portion of the vane slot and an adjacent portion of the inlet vane. Two examples are as follows.

First, the clearance between a portion of the vane slot 25*k* (or a position along the edge of the vane 25*k*) and an adjacent portion of the inlet vane 28 may be given by the distance between the portion of the vane slot 25*k* and the portion of the inlet vane 28 which lies on a straight line which extends away from said portion of the vane slot in a direction which is perpendicular to the profile (or surface, or edge) of said portion of the vane slot.

The second example of a method for determining the clearance between a portion of the vane slot 25*k* (or a position along the edge of the vane slot 25*k*) and an adjacent portion of the inlet vane 28 is defined with reference to a vane chord. The vane chord of the vane shown in FIG. 10 is indicated by the dotted line 46 and is defined as a straight line from the trailing end tip 29*b* of the vane 28 at the trailing end 28*b* of the vane 28 and the leading edge tip 29*a* of the vane 28 at the leading end 28*a* of the vane 28. The second example of defining the clearance between a portion of the vane slot 25*k* (or a position along the edge of the vane slot 25*k*) and an adjacent portion of the inlet vane 28 is where the distance between the portion of the vane slot and an adjacent portion of the inlet vane 28 is a straight line distance between the portion of the vane slot and the adjacent portion of the inlet vane. In this case, the straight line distance is measured along a straight the which extends from the portion of the vane slot to the adjacent portion of the inlet vane in a direction which is perpendicular to the vane chord 46. An example of the clearance between a portion of the vane slot and an adjacent portion of the inlet vane which has been determined using this method is indicated by the arrow 52. The clearance in this case, which is the distance indicated by the arrow 52, is measured along dotted line 58, which is perpendicular to the vane chord 46.

Figure 6:
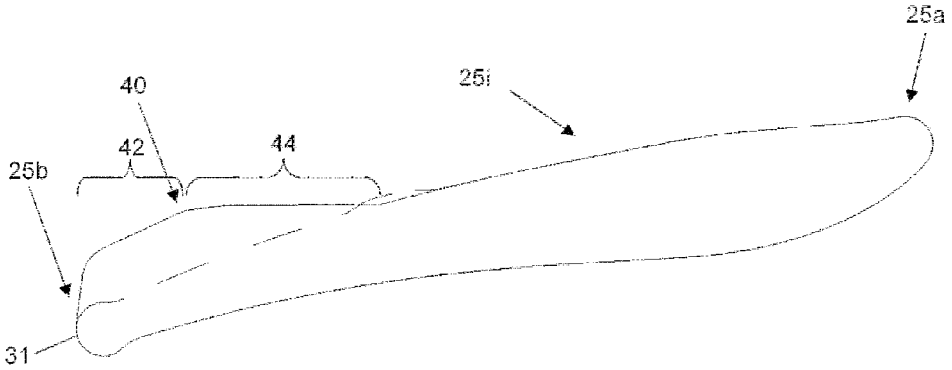
FIGS. 6 to 9 show separate configurations of vane slot according separate embodiments of the invention.
Figure 7:
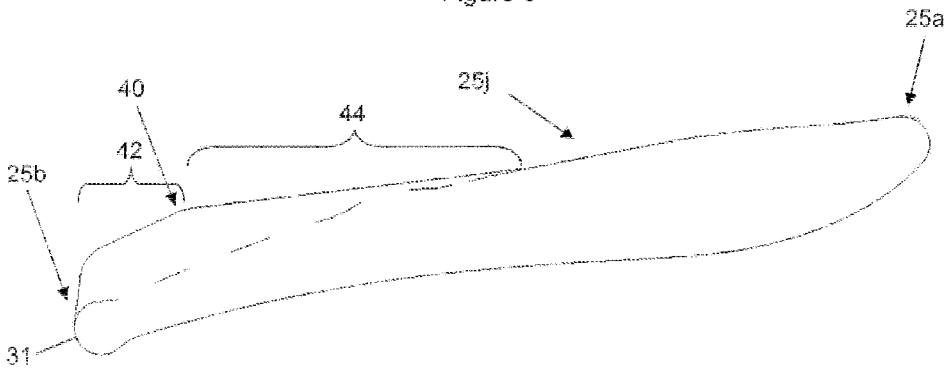
Figure 9:
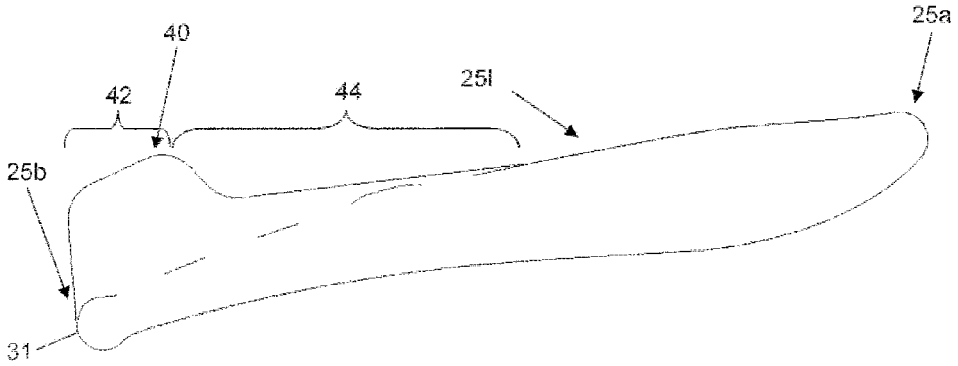

It will be appreciated that the vane slots according to the invention and shown in FIGS. 8, 9 and 10 each have a main region 42 of the increased clearance portion 40 which has a clearance which is significantly larger than the clearance between the vane and the vane slot in a large part of the tapered region 44 of the increased clearance portion 40. However, this need not be the case. For example, the vane slots according to the present invention shown in FIGS. 6 and 7 are configured such that the difference between the clearance in the main region 42 of the increased clearance portion 40 and the tapered region 44 of the increased clearance portion 40 is less than the equivalent difference in the vane slots according to the present invention shown in FIGS. 8 to 10.

Referring again to FIG. 10, it can be seen that the clearance between the edge of the vane slot 25*k* and the vane 28 is a maximum within the main region 42 of the increased clearance portion 40 of the vane slot. The clearance between the edge of the vane slot 25*k* and the vane decreases within the taper region 44 with increasing distance from the trailing end 28*b* of the vane. The clearance between the vane and the edge of the vane slot 25*k* decreases until a point C at which the clearance between the vane 28 and the edge of the vane slot 25*k* is substantially the same as the clearance between the vane and the vane slot at portions of the vane slot which are not part of the increased clearance portion 40. For example, the clearance between the vane and the edge of the vane slot 25*k* at point C is substantially the same as said clearance at points A and B.

It will be appreciated that in some embodiments of the invention the tapered region 44 of the increased clearance portion 40 may not exist and that there may be a step-change between the clearance between the vane and the edge of the vane slot in the increased clearance portion and said clearance in the portion of the vane slot which is not the increased clearance portion.

The increased clearance portion 40 of the vane slot 25*k* extends from the trailing end tip 29*b* of the trailing and 25*b* of the vane slot 25*k* to point C. I.e., the increased clearance portion 40 extends to a point along the edge of the vane slot at which the clearance between the vane and the edge of the vane slot is substantially the same as that at a point along the edge of the vane slot which is within portion of the vane slot which is not part of the increased clearance portion 40.

The point C to which the increased clearance portion 40 of the vane slot 25*k* extends may be any appropriate point. However, it has been found that there are operational limitations as to where point C should be located.

One way of defining the location of point C is to define it in terms of its position along the vane chord 46. This can be done as follows. Dotted line 48 is a straight line which extends in a direction perpendicular to the vane chord 46 and intersects with point C.

The distance between where the dotted line 48 intersects with the vane chord 46 and the trailing end of the vane chord 46 is indicated by arrow 50. The position of point C (i.e., the point to which the increased clearance portion 40 of the vane slot 25*k* extends) can be defined as a ratio between the length 50 (i.e., the length along the vane chord 46 from the trailing end of the vane chord at which point C is located) and the total length of the vane chord 46.

It has been found that if the length 50 is greater than about 75% of the total length of the vane chord 46 then the operating performance of the turbine of which the vane slot forms part may be detrimentally affected. It is thought that this is because, in use, the leading end of the vane (and hence vane slot) is at a greater pressure than the trailing end of the vane (and vane slot). In use, there is a pressure gradient between the relatively high pressure leading end of the vane (and vane slot) and the relatively low pressure trailing end of the vane (and vane slot). It has been found that when the length 50 of the increased clearance portion 40 is greater than about 75% of the length of the vane chord 46, the operating performance of the turbine of which such a vane slot forms part is adversely affected. This is because relatively high pressure gas near the leading and of the vane and vane slot may pass between the vane and increased clearance portion of the vane slot. Gas that passes between the vane and the vane slot will enter the shroud cavity (for example, 13 in FIGS. 1 and 2) located behind the shroud. If this occurs then the energy (for example, kinetic energy) of the gas which passes into the shroud cavity may be reduced due to the gas passing into the shroud cavity. The gas in the shroud cavity may then pass between the vane and the vane slot back towards the inlet passageway and the turbine wheel. It follows that the total energy of gas reaching the turbine wheel of the turbocharger is reduced. This leads to a reduction in the operating performance of the turbine and hence turbocharger. As previously discussed. It is preferable that the increased clearance portion 40 has a length 50 which is less than about 75% of the length of the vane chord 46. It has been found that if the length 50 of the increased clearance portion 40 is reduced even further, then there is a corresponding increase in the operating performance of the turbine of which the vane slot forms a part. This is because the smaller the length of the increased clearance portion 40, the greater the separation between the increased clearance portion 40 and the leading and 25*a* of the vane slot 25*k*. Increasing the separation between the increased clearance portion 40 and the leading end 25*a* of the vane slot 25*k* results in reducing the pressure to which the increased clearance portion 40 is exposed.

Although it is preferable that the length of the increased clearance portion 40 is less than about 75% of the length of the vane chord 46, in other embodiments it is preferable that the length 50 of the increased clearance portion 40 is less than about 60% of the length of the vane chord 46. In further embodiments of the invention it is preferable that the length 50 of the increased clearance portion 40 is less than about 50% of the length of the vane chord 46. In still further embodiments of the present invention the length 50 of the increased clearance portion may be less than at least one of about 40%, about 30% and about 20% of the length of the vane chord 46.

It is thought that providing an increased clearance portion 40 in the vane slot 25*k* reduces the occurrence of jamming between the nozzle ring and shroud because of the following. As previously discussed, it is thought that if contaminants (such as particles of debris) pass into the turbine of a turbocharger and then collide with the turbine wheel, this may cause said debris to be deflected in a direction which is generally radially outward. The speed of the contaminants which are deflected in a generally radially outward direction may be sufficiently great such that if they collide with the vanes of the turbine, the vanes will be deformed such that a portion of the vane moves radially outward. The thickness of the vane is greater at the leading end of the vane compared to that at the trailing end of the vane. As a consequence of this, the trailing end of the vane is more prone to being deformed by a collision or collisions with contaminants which have been deflected by the turbine wheel.

Due to the fact that it is believed that the trailing end of a vane is most susceptible to deformation, the increased clearance portion of the vane slot (a purpose of which is to accommodate deformation of the vane due to collisions of the contaminants with the vane) is located at the trailing end 25*b* of the vane slot. As previously discussed, this means that the increased clearance portion extends from the trailing end tip 29*b* of the trailing end 25*b* of the vane slot 25*k*. Furthermore, the increased clearance portion 40 of the vane slot 25*k* is located on the side of the vane slot 25*k* which is located away from the turbine wheel. This is because, if the vane is defected by the collision of at least one contaminant with the vane (the contaminant travelling in a direction that is generally radially outward due to its collision with the turbine wheel), then the direction of deformation of the vane will be generally radially outward (i.e., in a direction which is substantially away from the turbine wheel).

In order to accommodate sufficient deformation of the vanes (due to collisions with contaminants that have been deflected by the turbine wheel) so that the occurrence of jamming of the nozzle ring with the shroud is sufficiently reduced, the applicant has found that the length 50 of the increased clearance portion 40 of the vane slot should be at least about 10% of the length of the vane chord 46. It will be appreciated that the greater the length 50 of the increased clearance portion 40, the greater the deformation of the trailing end 28*b* of the vane 28 that can be accommodated. The greater the extent of deflection of the trailing end of the vane which can be accommodated, the less likely it is that a contaminant which has been deflected by the turbine wheel and has collided with the vane will cause the nozzle ring and shroud (and hence the variable geometry mechanism) to jam and hence become inoperable. In some embodiments, it is preferable that the length 50 of the increased clearance portion 40 of the vane slot 25*k* is at least one of about 20% and about 30% of the length of the vane chord 46.

It has been found that providing the vane slot with an increased clearance portion in accordance with the present invention has not significantly affected the aerodynamic efficiency of the turbine and hence turbocharger. That is to say, providing the vane slot with an increased clearance portion in accordance with the present invention has not significantly reduced the efficiency with which the turbine (and hence turbocharger) converts the energy of the gas flowing into the turbine into useful work in the form of rotation of the turbine wheel and anything mechanically linked to the turbine wheel.

In some applications it is undesirable for the portion of the vane slot which is not the increased clearance portion to have a clearance between the vane and the vane slot which is any greater than that which is necessary to accommodate the relative sliding motion between the vane and the vane slot and/or to accommodate a minor degree of thermal expansion. This is due to the fact that any unnecessary clearance between the vane and the vane slot will result in additional flow, in use, of gas between the vane and the vane slot into the shroud cavity. As previously discussed, the flow of gas into the shroud cavity will result in a reduction in the operating performance of the turbine. For example, it is preferable that the leading end of the vane slot and the side of the vane slot which is closest to the turbine wheel do not have clearance between the vane and the vane slot which is greater than the minimum clearance required to allow the vane to slide within the vane slot and to accommodate a small degree of thermal expansion. This is because in the case of the side of the vane slot which is closest to the turbine wheel increased clearance in this area would not accommodate deformation of the vane in a direction which is generally away from the turbine wheel. In the case of the leading edge of the vane slot, as previously discussed, due to the fact that the leading edge of the vane is of greater thickness than the trailing edge of the vane, it is much less likely for the leading edge of the vane to deform compared to the trailing edge of the vane. Despite the fact that increased clearance at the side of the vane slot which is closer to the turbine and at the leading edge of the vane is unlikely to accommodate any deformation of the vane due to the collision with contaminants deflected by the turbine wheel, increased clearance in these areas would lead to a reduction in turbine operating performance as previously discussed.

The clearance between the vane 28 and the edge of the vane slot 25*k* in the increased clearance portion 40 of the vane slot 25*k* may be any appropriate size. For example, as shown in FIG. 10, the maximum clearance between the vane and the vane slot 25*k* (or the edge of the vane slot 25*k*) within the main region 42 of the increased clearance portion 40 of the vane slot 25*k* is indicated by the arrow 52. In this case, the maximum clearance between the vane and the vane slot 25*k* (or the edge of the vane slot 25*k*) is measured as a straight line distance between a maximum clearance portion of the vane slot and an adjacent portion of the vane in a direction perpendicular to the vane chord 46.

The maximum clearance between the vane and the edge of the vane slot 25*k* may be defined in terms of the thickness of the vane. The thickness of the vane may be measured in a direction perpendicular to the vane chord 46. The thickness of the vane may be measured at the portion of the vane (also referred to as the adjacent portion of the vane) to which the maximum clearance is measured. In this case, the thickness of the adjacent portion of the vane 28 is indicated by the arrows 54. Within FIG. 10 the arrows 54 have been moved to the right of the distance they demarcate in order to aid clarity within the Figure. It will be appreciated that the distance signified by the arrows 54 is the distance for which the dotted line 56 (which is perpendicular to the vane chord 46) passes through the vane 28.

It has been found that in certain embodiments, if the ratio between the maximum clearance 52 between the vane 28 and the increased clearance portion 40 of the vane slot 25*k*, and the thickness of the vane 54 (i.e. the maximum clearance divided by the vane thickness) is greater than about 7, this may be undesirable. This is because if the clearance between the vane and vane slot 25*k* in the increased clearance portion of the vane slot 25*k* is greater than 7 times the thickness of the vane 54, then the increased clearance portion 40 creates a gap between the vane 28 and the increased clearance portion of the vane slot 25*k* that is sufficiently large such that a large volume of gas flows between the vane 28 and vane slot 25*k*, in use, into the shroud cavity. This may cause the operating performance of the turbine is reduced. This may be because if the clearance between the vane and vane slot 25*k* in the increased clearance portion of the vane slot 25*k* is greater than 7 times the thickness of the vane 54, then the aerodynamic efficiency of the gas passing through the inlet passageway to the turbine wheel is reduced.

Furthermore, it has been found that if the maximum clearance between the vane 28 and the vane slot 25*k* in the increased clearance portion is greater than about 7 times the thickness 54 of the vane 28 that corresponds to the clearance, then very few additional vane deformations due to contaminants deflected by the turbine wheel are accommodated compared to when the clearance is about 7 times the corresponding thickness of the vane. In some embodiments it is preferable for the clearance between the vane and the increased clearance portion of the vane slot to be less than at least one of about 6 times, about 5 times, about 4 times, about 3 times, or about 2 times the corresponding thickness 54 of the vane 28.

It has been found that, in order for the increased clearance portion to be effective, the minimum clearance may be greater than the corresponding thickness 54 of the vane 28. As such, the maximum clearance between the increased clearance portion of the vane slot occurs between a maximum clearance portion of the vane slot and an adjacent portion of the inlet vane, the maximum clearance being greater than the thickness of the adjacent portion of the inlet vane. The adjacent portion of the inlet vane is aligned with the maximum clearance portion of the vane slot in a direction which is perpendicular to the vane chord. The thickness of the adjacent portion of the inlet vane is measured perpendicular to the vane chord.

In other embodiments, it is preferable that the maximum clearance between the vane 28 and the increased clearance portion 40 of the vane slot 25*k* is at least one of about 1.25, about 1.5, about 1.75 and about 2 times the thickness of the adjacent portion of the inlet vane.

It is thought that the provision of an increased clearance portion of the vane slot may also reduce shroud plate wear and improve shroud plate retention. The reason for this is as follows. In some applications the turbocharger, and more specifically the inlet to the turbine of the turbocharger, is connected to the exhaust manifold of an engine. Conventional engines operate such that combustion occurs in individual cylinders in succession. As a result, the exhaust gas produced by the engine (and hence the exhaust gas supplied to the turbine of the turbocharger) tends to be pulsed. This pulsed supply of exhaust gas to the turbine of the turbocharger causes periodic variations in the pressure of the exhaust gas which is supplied to the turbocharger turbine. As previously discussed, the pressure of the exhaust gas within the inlet passageway of the turbine may be such that the pressure of the exhaust gas towards the leading end of the nozzle vanes (which corresponds to the outer diameter of the nozzle ring/shroud plate) is greater than the pressure of the exhaust gas towards the trailing end of the nozzle vanes (which corresponds to the inner diameter of the nozzle ring/shroud plate).

In some applications the difference in pressure between the outer diameter of the nozzle ring/shroud plate and the inner diameter of the nozzle ring/shroud plate may be enhanced by the periodic variation in the pressure of the exhaust gas produced by the engine. The pressure difference between the exhaust gas at the outer diameter of the nozzle ring/shroud plate compared to that at the inner diameter of the nozzle ring/shroud plate may lead to exhaust gas being sucked between the nozzle vanes and the shroud plate into the shroud cavity behind the shroud plate and then expelled from between the shroud plate and the nozzle vanes from the shroud cavity back into the turbine inlet passageway. This movement of gas in to and out of the shroud cavity may also be periodic. This periodic movement of gas may cause the shroud plate to flex in a repetitive manner. Such flexing may reduce the lifetime of the shroud plate and/or adversely affect the retention of the shroud plate within the turbine. If the shroud plate were to become detached from the turbine then this may lead to failure of the turbocharger.

The presence of an increased clearance portion in the vane slot may reduce the occurrence of exhaust gas repetitively passing in to and out of the shroud cavity and thereby reduce the detrimental effect of this process on the shroud plate. The reason that the provision of en increased clearance portion may reduce the repetitive passage of exhaust gas in to and out of the shroud cavity is as follows. The increased clearance portion of the vane slot is located at the trailing end of the vane slot. The increased clearance portion of the vane slot provides a significantly large flow passage for exhaust gas to pass between the vane and the vane slot. As such, the increased clearance portion of the vane slot provides a larger flow passageway (compared to a similar vane/vane slot without an increased clearance portion) between the relatively low pressure exhaust gas at the trailing end of the vane/vane slot in the inlet passageway and the shroud cavity. It has been found that increasing the size of the flow passageway between the relatively low pressure gas at the trailing end of the vane/vane slot in the inlet passageway and the shroud cavity reduces the difference in pressure between the inlet passageway and the shroud cavity (i.e. the difference in pressure between that at either side of the shroud plate). Hence, the amount of exhaust gas that is sucked into and then emitted from the shroud cavity is reduced. As previously discussed, this may lead to an increase in the lifetime of the shroud plate and/or improved retainment of the shroud plate.

It can be seen that the invention shown within FIGS. 6 to 10 all incorporate a portion of the bulbous end at the trailing end of the vane slot. This is to that the vane slot can accommodate a degree of thermal expansion at the trailing end of the vane. It will be appreciated that other embodiments of the invention may not incorporate such a bulbous end feature.

It will be appreciated that although the embodiments of the invention described have nozzle vanes which form part of a movable nozzle wall, and a shroud which is fixed within the turbine, this need not always be the case. For example, in some embodiments of the invention, the nozzle vanes may be fixed relative to the turbine and the vane slots may form part of a movable shroud.

It will further be appreciated that it is within the scope of the present invention for a turbine according to the present invention to have any appropriate number of corresponding vanes and vane slots. Furthermore, it will be appreciated that it is within the scope of the invention for a turbine according to the invention to have more than one configuration of corresponding vanes and vane slots.

The invention claimed is:

1. A variable geometry turbine comprising:

a housing;

a turbine wheel supported in the housing for rotation about a turbine axis;

an annular inlet passage upstream of said turbine wheel defined between respective inlet surfaces defined by an annular nozzle ring and a facing annular shroud;

the nozzle ring and shroud axially movable relative to one another to vary a size of the inlet passage;

the nozzle ring having a circumferential array of inlet vanes extending across the inlet passage;

the shroud covering an opening of a shroud cavity and defining a circumferential array of vane slots, each vane slot corresponding to an inlet vane, the vane slots and shroud cavity being configured to receive said inlet vanes to accommodate axial movement of the nozzle ring;

wherein at least one vane slot has a first side corresponding to a first side of the corresponding inlet vane and a second side corresponding to a second side of the corresponding inlet vane, the first side of the vane slot being located a shorter radial distance from the turbine wheel than the second side of the vane slot;

wherein the at least one vane slot has a leading end corresponding to a leading end of a corresponding inlet vane, and a trailing, end downstream of the leading end, the trailing end corresponding to a end of the inlet vane;

wherein a vane chord extends in a straight line between a leading end tip and a trailing end tip of the inlet vane;

wherein the at least one vane slot, has an increased clearance portion, a clearance between a portion of the at least one vane slot, which forms part of the increased clearance portion, and an adjacent portion of the inlet vane being greater than a clearance between a further portion of the at least one vane slot, which does not form part of the increased clearance portion, and an adjacent portion of the inlet vane;

the increased clearance portion being located at the second side of the vane slot and extending from a trailing end tip of the trailing end of the vane slot to a point which is a distance from the trailing end of the vane slot, in the direction of the vane chord, that is greater than about 10% of the length of the vane chord.

2. The variable geometry turbine according to claim 1, wherein a maximum clearance between the increased clearance portion of the vane slot occurs between a maximum clearance portion of the vane slot and the inlet vane, the maximum clearance being greater than a thickness of a portion of the inlet vane which is aligned with the maximum clearance portion in a direction which is perpendicular to the vane chord; the thickness of the vane being measured perpendicular to the vane chord.

3. The variable geometry turbine according to claim 1, wherein the shroud comprises a shroud plate defining a generally radial surface, the circumferential array of vane slots passing through the generally radial surface.

4. The variable geometry turbine according to any claim 1, wherein the increased clearance portion of the at least one vane slot comprises a main region and a tapered region, the main region extending from the trailing end tip of the trailing end of the vane towards leading end of the vane slot, the tapered region adjoining the main region.

5. The variable geometry turbine according to claim 4, wherein a clearance between the vane and the edge of the vane slot within the main region of the increased clearance portion is greater than that of a clearance between the vane and edge of the vane slot in the tapered region of the increased clearance portion.

6. A turbocharger comprising a turbine according to claim 1.

7. A variable geometry turbine comprising;

a housing;

a turbine wheel supported in the housing for rotation about a turbine axis;

an annular inlet passage upstream of said turbine wheel defined between respective inlet surfaces defined by an annular nozzle ring and a facing annular shroud;

the nozzle ring and shroud being axially movable relative to one another to vary a size of the inlet passage;

the nozzle ring having a circumferential array of inlet vanes extending across the inlet passage;

the shroud covering an opening of a shroud cavity and defining a circumferential array of vane slots, each vane slot corresponding to an inlet vane, the vane slots and shroud cavity being configured to receive said inlet vanes to accommodate axial movement of the nozzle ring; wherein at least one vane slot has a first side corresponding to a first side of the corresponding inlet vane and a second side corresponding to a second side of the corresponding inlet vane, the first side of the vane slot being located a shorter radial distance from the turbine wheel than the second side of the vane slot;

wherein the at least one vane slot has a leading end corresponding to a leading end of a corresponding inlet vane, and a trailing end downstream of the leading end, the trailing end corresponding to a trailing end of the inlet vane;

wherein a vane chord extends in a straight line between the leading end and the trailing end of the inlet vane;

wherein the at least one vane slot has an increased clearance portion, a clearance between a portion of the at least one vane slot, which forms part of the increased clearance portion, and an adjacent portion of the inlet vane being greater than a clearance between a further portion of the at least one vane slot, which does not form part of the increased clearance portion, and an adjacent portion of the inlet vane;

the increased clearance portion being located at the second side of the vane slot and extending from a trailing end tip of the trailing end of the vane; and wherein a maximum clearance between the increased clearance portion of the vane slot and the inlet vane occurs between a maximum clearance portion of the vane slot and an adjacent portion of the inlet vane, the maximum clearance being greater than a thickness of the adjacent portion of the inlet vane, the adjacent portion of the inlet vane being aligned with the maximum clearance portion of the vane slot in a direction which is perpendicular to the vane chord; the thickness of the adjacent portion of the inlet vane being measured perpendicular to the vane chord.

8. The variable geometry turbine according to claim 7, wherein the maximum clearance between the increased clearance portion of the vane slot and the inlet vane is less than about 7 times the thickness of the adjacent portion of the inlet vane.

9. The variable geometry turbine according to claim 7, wherein the shroud comprises a shroud plate defining a generally radial surface, the circumferential array of vane slots passing through the generally radial surface.

10. The variable geometry turbine according to claim 7, wherein the increased clearance portion of the at least one vane slot comprises a main region and a tapered region, the main region extending from the trailing end tip of the trailing end of the vane towards leading end of the vane slot, the tapered region adjoining the main region.

11. The variable geometry turbine according to claim 10, wherein a clearance between the vane and the edge of the vane slot within the main region of the increased clearance portion is greater than that of a clearance between the vane and edge of the vane slot in the tapered region of the increased clearance portion.

12. A turbocharger comprising a turbine according to claim 7.

* * * * *